US006592118B2

(12) United States Patent
Youn

(10) Patent No.: US 6,592,118 B2
(45) Date of Patent: Jul. 15, 2003

(54) MEDIA CASSETTE FOR AUTOMATIC DISPENSER

(75) Inventor: Ki Cho Youn, Seoul (KR)

(73) Assignee: LG Electronics, Inc., Seoul (KR)

( * ) Notice: Subject to any disclaimer, the term of this patent is extended or adjusted under 35 U.S.C. 154(b) by 25 days.

(21) Appl. No.: 09/985,174

(22) Filed: Nov. 1, 2001

(65) Prior Publication Data

US 2002/0056720 A1 May 16, 2002

(30) Foreign Application Priority Data

Nov. 1, 2000 (KR) ..... 64726/2000
Oct. 26, 2001 (KR) ..... 66232/2001

(51) Int. Cl.[7] ..... B65H 1/08

(52) U.S. Cl. ..... 271/147; 271/157; 271/160; 271/162; 271/171

(58) Field of Search ..... 271/145, 147, 271/157, 160, 162, 171

(56) References Cited

U.S. PATENT DOCUMENTS 2,849,153 A * 8/1958 Tuttle
3,425,595 A * 2/1969 Shapira
4,280,692 A * 7/1981 Hutchinson et al. ..... 271/160
5,092,575 A * 3/1992 Ramsey ..... 271/145 X
5,100,022 A * 3/1992 Fukudome et al. ..... 221/198

FOREIGN PATENT DOCUMENTS

JP 8-290836 11/1996

* cited by examiner

*Primary Examiner*—David H. Bollinger
(74) *Attorney, Agent, or Firm*—Fleshner & Kim, LLP

(57) ABSTRACT

A media cassette for an automatic dispenser which can be used easily and solve problems of incorrect operations when a push plate is locked since if the automatic dispenser receives the cassette having a locked push plate, locking is automatically released. The media cassette for an automatic dispenser includes a cassette body having a certain interior space in which media is received, a push plate installed slidably in the cassette body for supporting media, an elastic member positioned between the push plate and the cassette body for urging the push plate, guide members installed between the both sides surfaces of the push plate and the inner sides of the cassette body for guiding the push plate to perform linear movement and a locking mechanism installed between the push plate and the cassette body for locking the push plate and releasing the locking of the push plate in case the media cassette is received in the automatic dispenser.

21 Claims, 4 Drawing Sheets

MEDIA CASSETTE FOR AUTOMATIC DISPENSER

BACKGROUND OF THE INVENTION

1. Field of the Invention

The present invention relates to a media cassette for an automatic dispenser such as a paper currency dispenser and particularly, to a media cassette for an automatic dispenser in which a push plate locking latch in the media cassette is automatically unlatched when the media cassette is received in the automatic dispenser.

2. Description of the Background Art

Generally, an automatic dispenser is applied to automatic teller machines (ATMs). An ATM generally is provided with a space for receiving a media cassette to store cash (paper currency) which is a medium and with a door for locking the media cassette after receiving the media cassette therein.

FIG. 1 is a top plan view showing a conventional media cassette for an automatic dispenser and FIG. 2 is a front view showing the conventional media cassette for an automatic dispenser.

The conventional media cassette for the automatic dispenser includes a cassette body 102 having an interior space in which media may be stored, a push plate 104 installed slidably in the cassette body 102 for supporting media received in the cassette body 102, a spring 106 positioned between the push plate 104 and an inside wall of the cassette body 102 for urging the push plate 104, and a guide installed between the push plate 104 and the cassette body 102 for slidably supporting the push plate 104.

The cassette body has a rectangular shape with the one side opened and a guide line 108 which is slid at the upper side when the media cassette is installed in the automatic dispenser.

The push plate 104 is positioned movably in the cassette body 102 standing upright and at the one upper end of the cassette body, a handle 110 is formed which a user can hold and pull out. As mentioned between the rear surface of the push plate 104 and the inner rear wall surface of the cassette body 102, a spring 106 is installed to provide an elastic force to the push plate 104.

The guide includes a guide rails 112 which are installed on the both inner side walls of the cassette body 102 in the longitudinal direction thereof and guide rollers 114 which are installed at the both sides of the push plate 104 rotatably and abutted to the respective guide rails 112.

The guide rollers 114 are supported on rotation shafts 116 which are installed at both sides of the push plate 104 in the upright direction.

The operation of the conventional media cassette for an automatic dispenser will be described as follows.

If the handle 110 formed in the push plate 104 is pulled to the rear, the push plate 104 moves rearwardly overcoming the elastic force of the spring 106. After moving the push plate 104, media are received to the inside of the cassette body 102 sequentially with the push plate 104 being held back manually to prevent the push plate 104 from moving forwardly.

In case the handle 110 of the push plate 104 is released after completing loading of the media, the push plate 104 moves forwardly by the elastic force of the spring 106 and the media between the cassette body 102 and the push plate 104 is pressed by a certain elastic force. Once the loading is completed, the media cassette is ready to be installed and used for the automatic dispenser.

However, the conventional media cassette for the automatic dispenser has problems that the operation is difficult, the operation time is long and inferior results are produced in case of installing it in the automatic dispenser due to the irregular reception of the media after the operation since a user must move the support plate rearwardly and hold it so that it with one hand cannot move forwardly while holding the media into the cassette body with the other hand.

To solve the above problem, a locking tool is installed between the support plate and the cassette body, the push plate is pulled backed and locked, media is loaded, and when a locking release button is pushed, locking of the push plate is released thus to support the media.

However, in the above conventional media cassette, locking of the push plate must be released before loading the media cassette into the automatic dispenser. In case the user loads the media cassette into the automatic dispenser without pushing the locking release button by mistake, there occurs a problem that the media are not supplied to the dispenser because the push plate is held in the locked state.

Also, since the conventional media cassette can store only one kind of media, media of different sizes can not be stored thus to limit the usage of the cassette.

SUMMARY OF THE INVENTION

Therefore, an object of the present invention is to provide a media cassette for an automatic dispenser which can be used easily and which solves the problems of incorrect operation in case of loading a cassette with a locked push plate since locking of the push plate is automatically released if the automatic dispenser receives the cassette with a locked push plate.

Another object is to provide a media cassette for an automatic dispenser which can store many kinds of media having different sizes since the width of the cassette body can be changed according to the size of the stored media thus to broaden the usefulness.

To achieve these and other advantages and in accordance with the purpose of the present invention, as embodied and broadly described herein, there is provided a media cassette for an automatic dispenser, comprising a cassette body having an interior space in which media to be dispensed may be received, a push plate installed slidably in the cassette body for supporting media received therein, an elastic member positioned between the push plate and the cassette body for urging the push plate, guide means installed between side surfaces of the push plate and inner sides of the cassette body for guiding the push plate to perform linear movement, and locking means installed between the push plate and the cassette body for locking the push plate to the cassette body and for automatically releasing the locking of the push plate when the media cassette is inserted into an automatic dispenser.

The guide means comprises a guide rod installed at each side of the cassette body and extending in a longitudinal direction thereof and a guide hole formed at the each side of the push plate and respectively fixed slidably to the corresponding guide rod.

A bushing is fixed inside each guide hole to facilitate sliding of the push plate.

The locking means comprises a hook part coupled to a rear wall of the cassette body and protruded to the inner side of the cassette body for performing locking operation of the push plate, a hook assembly having a locking release button part protruded to the outside of the cassette body for being operated when the cassette is inserted into an automatic dispenser, to release the locking and a latching pin provided on the push plate and engageable by the hook assembly.

The hook assembly comprises a bracket which is fixed an the installing hole formed in the cassette body, a hinge shaft fixed to the bracket, a hook member having a side protruded to the inner side of the cassette body forming a hook part which is protruded outwardly from the cassette body and engageable with the latching pin and another side having a locking release button part for releasing latching operation and being rotatable on the hinge shaft and a return spring for urging the hook member to its original position on the hinge shaft.

The locking release button part of the hook member is formed protruded outwardly of the cassette body at a certain angle so that the button can be pushed and operate when a door of the automatic dispenser is closed.

The latching pin is fixed to two mounting parts which are protruded at a certain interval from the rear surface of the cassette body.

A retaining ring is fixed at each end of the latching pin.

The media cassette for an automatic dispenser comprises a cassette body having an interior space in which media to be dispensed may be received, a push plate installed slidably in the cassette body for supporting media received therein, an elastic member positioned between the push plate and the cassette body for urging the push plate, a guide means installed between each side of the push plate and each side of the cassette body to guide the push plate to perform linear movement and a width varying means installed on a bottom surface of each sides of the cassette body for varying the width of the interior space in the cassette body according to the size of media to be received therein.

The width varying means comprises a support panel installed at each side of the cassette body extending in a longitudinal direction for supporting both side edge of the media, position determining holes formed in a bottom surfaces at both sides at the cassette body at intervals so that the position of the support panels in a transverse direction of the cassette body can be changed according to the size of the media to be received in the cassette body and position fixing bolts for fixing the support panels in the position determining holes.

The media cassette for an automatic dispenser comprises a cassette body having an interior space in which media to be dispensed can be received, a push plate installed slidably in the cassette body for supporting media received therein, an elastic member positioned between the push plate and the cassette body for urging the push plate, a guide means installed between each side surfaces of the push plate and inner sides of the cassette body for guiding the push plate to perform linear movement, a locking means installed between the push plate and the cassette body for locking the push plate and releasing the locking of the push plate when the media cassette is inserted into the automatic dispenser and a width varying means installed on a bottom surface at both sides of the cassette body for varying the width of the cassette body according to the media to be received therein.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
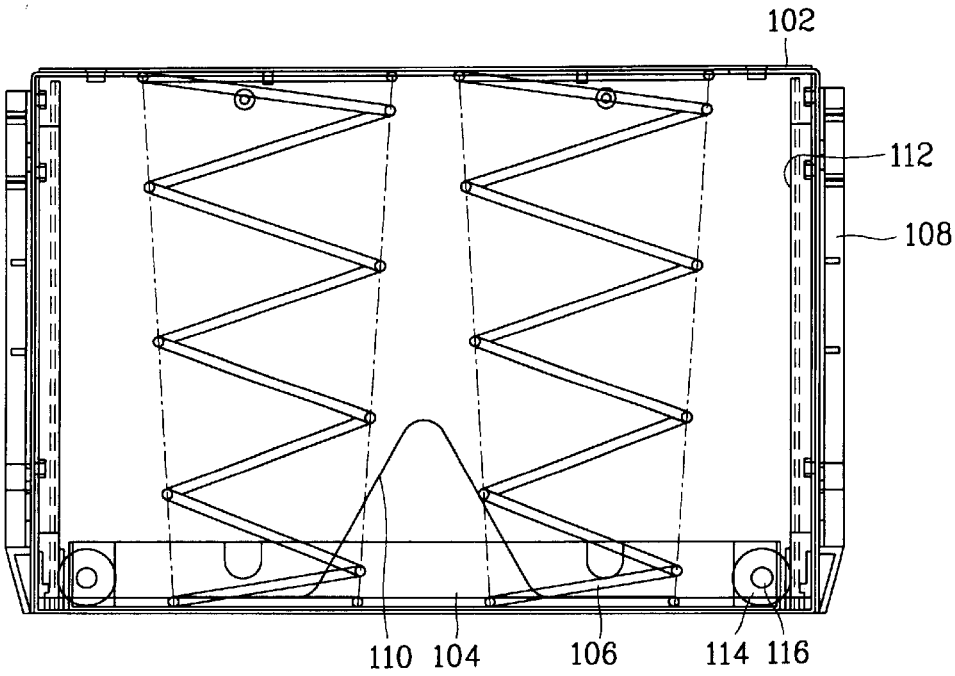
FIG. 1 BACKGROUND ART
FIG. 1 is a top plan view showing a conventional media cassette for an automatic dispenser.
Figure 2:
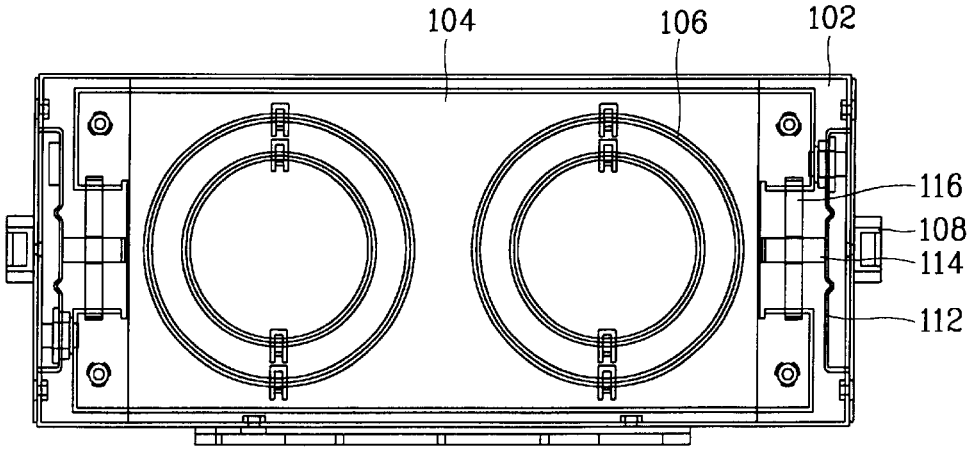
FIG. 2 BACKGROUND ART
FIG. 2 is a front view showing the conventional media cassette for an automatic dispenser.
Figure 3:
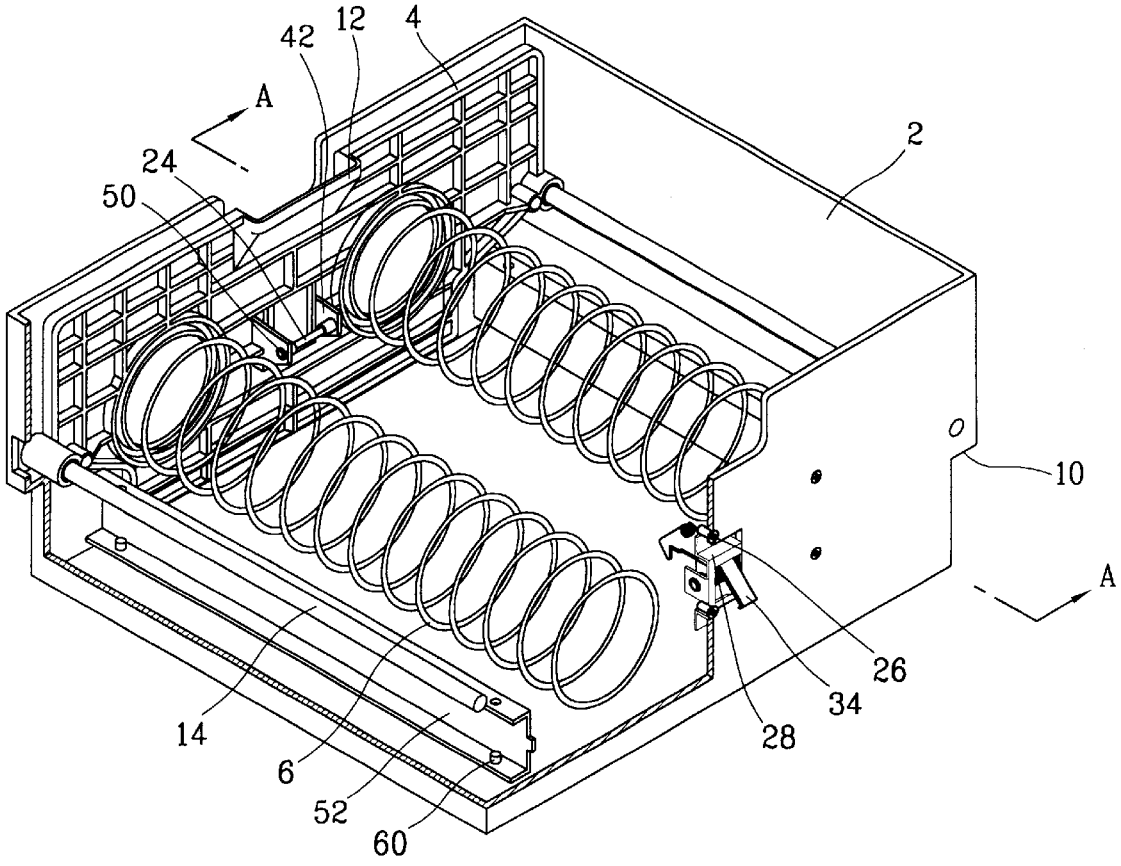
FIG. 3 is a perspective view showing a media cassette for an automatic dispenser in accordance with the present invention.
Figure 4:
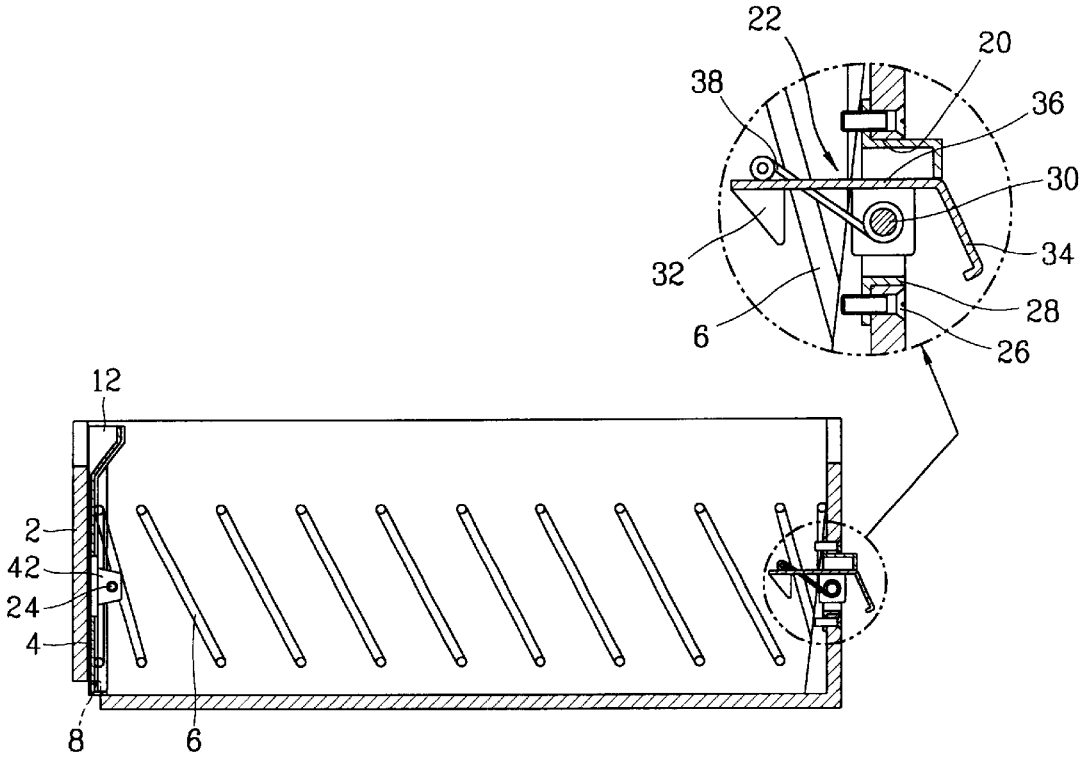
FIG. 4 is a sectional view of taken along section line A—A in FIG. 3.
Figure 5:
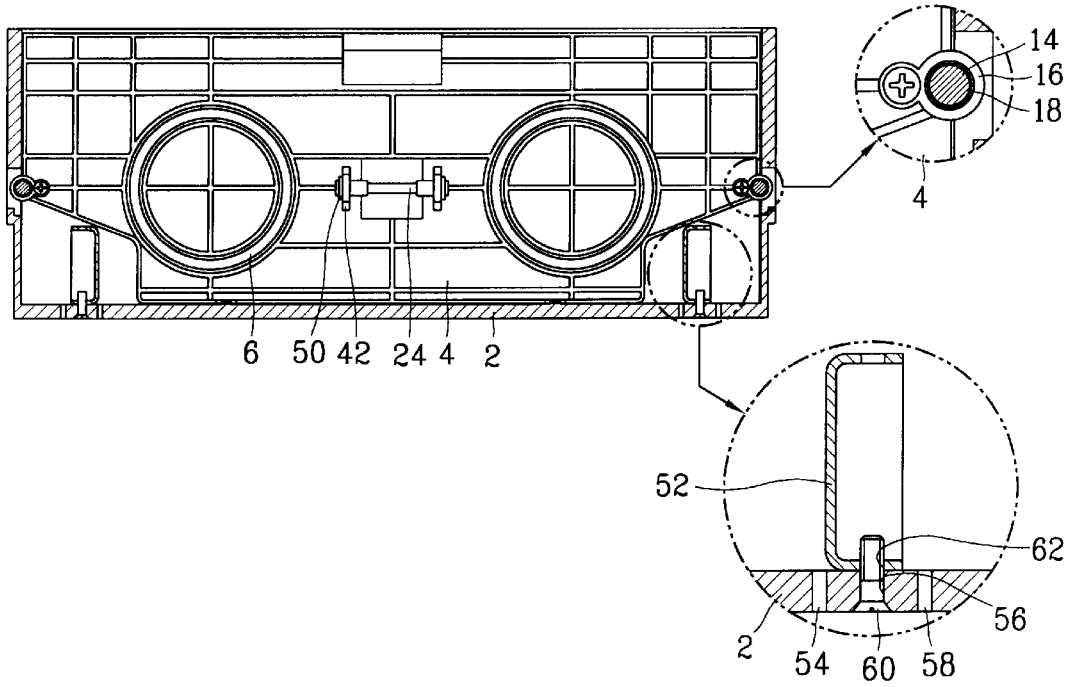
FIG. 5 is a sectional view showing a width varying means of the media cassette in accordance with the present invention.

FIG. 3 is a perspective view showing a media cassette for an automatic dispenser in accordance with the present invention, FIG. 4 is a sectional view taken along section line A—A in FIG. 3 and FIG. 5 is a sectional view showing a width varying means of the media cassette in accordance with the present invention.

The media cassette for an automatic dispenser includes a cassette body 2 having a certain interior space in which media to be dispensed is received, a push plate 4 installed slidably in the cassette body 2 for supporting media received therein, an elastic member 6 positioned between the push plate 4 and the cassette body 2 for urging the push plate towards a dispensing position of the media, guide members installed between the both side surfaces of the push plate 4 and the inner sides of the cassette body 2 for guiding the push plate 4 to perform linear movement, and a locking mechanism installed between the push plate 4 and the cassette body 2 for locking the push plate 4.

In the cassette body 2, a width varying device which can vary the width of the interior space in the cassette body 2 according to the size of the media is installed.

The cassette body 2 has a rectangular shape. At a front lower side of the cassette body, an outlet port 8 for discharging stored media is formed and a guide line 10 which guides the media in case of receiving the media into the automatic dispenser is formed at both side surfaces.

The push plate 4 is installed in the cassette body 2 standing upright and having a shape of a flat plate and has a handle 12 with which a user can hold and pull at the center of the upper side of the push plate.

The elastic member 6 has an end fixed on the rear surface of the push plate 4 and another end having a coil spring fixed on the inner wall surface of the cassette body 2 for pushing the push plate 4.

As shown in FIG. 5, the guide members include a guide rods 14 which are installed at the both sides of the cassette body extending in the longitudinal direction and guide holes 16 formed at the both sides of the push plate 4 and respectively fixed slidably on the guide rods 14.

Here, in each of the guide holes 16, a bushing 18 is inserted thus to help the guide holes slide on the guide rods 14.

The locking mechanism includes a hook assembly 22 mounted through an installing hole 20 which is formed in the center of the rear side wall of the cassette body 2 for locking the push plate 4 and a latching pin 24 provided at the center of the rear side of the push plate 4 and engageable by the hook assembly 22.

The hook assembly 22 includes a bracket 28 which is mounted in the installing hole 20 as formed in the cassette body 2 with bolts 26, a hinge shaft 30 transversely fixed to the bracket 28, a hook member 36 having an end protruded to the inner side of the cassette body 2 forming a hook part 32 which is protruded outwardly from the cassette body 2 and engageable with the latching pin 24 and another end having a locking release button part 34 for releasing locking operation under the condition of being rotated on the hinge shaft 30 and a return spring 38 for urging the hook member 36 to its original position on the hinge shaft 30.

Here, the locking release button part 34 of the hook member is formed to be protruded outwardly of the cassette body 2 at a certain angle so that the button can be pushed and operated when a door of the automatic dispenser is closed.

The latching pin 24 is fixed to two mounting parts which are protruded at a certain interval from the rear surface of the cassette body 2, and retaining ring 50 for preventing separation of the latching pin 24 are installed at both ends of the latching pin 24.

The locking mechanism overcomes the elastic force of the elastic member 6 and the push plate 4 moves inwardly in the cassette body 2 in case of holding and pulling the handle 12 of the push plate. At this time, the latching pin 24 is latched by the hook part 32 of the hook member and the push plate 4 is locked. In this condition, if the door (not shown) of the automatic dispenser is closed after the media are stored in the cassette body 2, the rear surface of the door pushes the locking release button part 34, whereby the hook member rotates out of latching engagement with the latching pin and thereby locking of the push plate 4 is released and the push plate 4 supports the media with certain elastic force.

As shown in FIG. 5, the width varying device includes a support panel 52 installed at each side of the cassette body 2 extending in the longitudinal direction for respectively supporting both side surfaces of the media, first, second and third position determining holes 54, 56 and 58 which are formed in the bottom surface at both sides of the cassette body 2 at certain intervals so that the position of the support panels 52 in the transverse direction in the cassette body 2 can be changed according to the size of the media stored and position fixing bolts 60 for fixing the support panels 52 to the position determining holes 54, 56 and 58.

The number of the position determining holes 54, 56 and 58 can be increased accordingly as the size of the media varies.

Each supporting panel 52 has a bolt hole 62 where a position fixing bolt 60 is installed on the surface abutted on the bottom surface of the cassette body 2.

The width varying device fixes the supporting panels 52 by selecting one of the first, second and third position determining holes 54, 56 and 58 according to the size of the stored media.

Operation of the media cassette for the automatic dispenser in accordance with the present invention with the above composition will be described.

Figure 6:
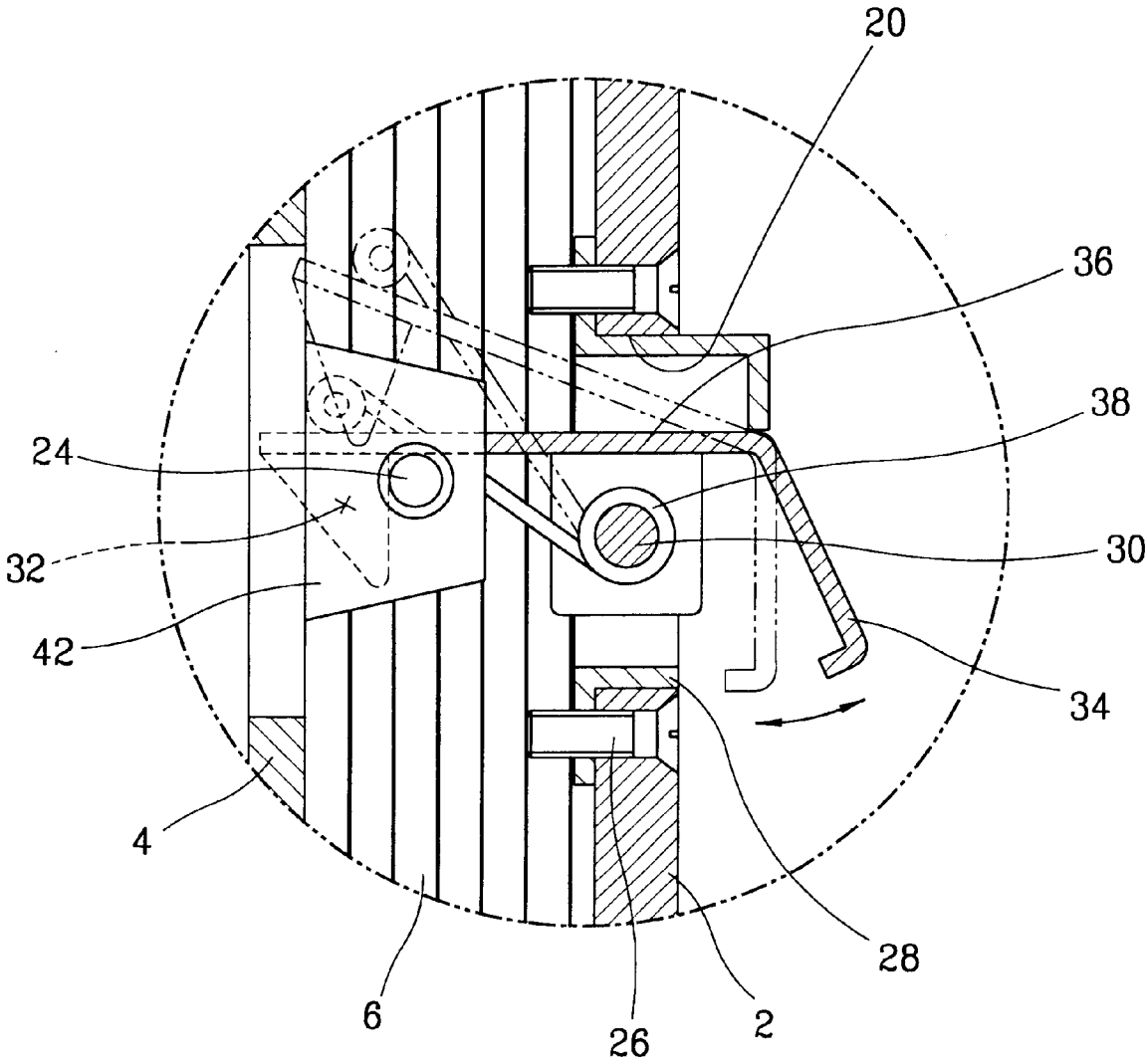
FIG. 6 is a block diagram showing the media cassette in accordance with the present invention.

FIG. 6 is a block diagram showing the media cassette in accordance with the present invention.

Firstly, in case of holding and pulling back the handle 12 of the push plate to secure a space for storing the media, the push plate 4 overcomes the elastic force of the elastic member 6 and moves inwardly in the cassette body 2. At this time, the push plate 4 performs linear movement along through the guide rods 14 since the guide holes 16 of the push plate 4 move along the guide rods 14 of the cassette body 2.

If the push plate 4 moves to near the rear portion of the cassette body 2, the latching pin 24 which is installed on the push plate 4 is latched on the hook assembly 22 installed at the rear of the cassette body 2 and the push plate 4 is locked.

In this condition, after storing the media in the cassette body 2, the media cassette is ready to be received into the automatic dispenser. Here, if the door of the automatic dispenser is closed after receiving the media cassette into the automatic dispenser, the rear surface of the door pushes the locking release button part 34 of the hook assembly and accordingly, the locking of the push plate is related and the media is supported elastically toward the dispensing end due to releasing of the locking of the push plate 4.

Namely, if the rear surface of the door pushes the locking release button part 34, the hook member 36 rotates around the hinge shaft 30, whereby the hook part 32 is separated from the latching pin 24 and locking is released.

In case of storing a media having a bigger size than that of the currently stored media, the position fixing bolts 60 are tightened after moving the supporting panels 52 to the direction of the inside of the cassette body and aligning the bolt holes 62 with the third position determining hole 58. On the contrary, in case of storing a media having a smaller size than that of the currently stored media, the position fixing bolt 60 is tightened after moving the supporting panel 52 to the direction of the inside of the cassette body and aligning the bolt holes 62 with the first position determining hole 54.

The media cassette in accordance with the present invention with the above composition and operation can prevent a incorrect operation generated in case of receiving the cassette with a push plate of which locking is not released by releasing locking of the push plate by having the door push the locking release button if the media cassette is received and the door is closed after storing the media by locking the push plate with the locking mechanism and the present invention has an advantage that its use is convenient since locking of the push plate does not need to be released by hand.

Also, the media cassette in accordance with the present invention has another advantage that its usefulness can be widened since media of many difference side edges can be received by having the supporting panels for supporting the both sizes of the media movable at the both sides of the cassette body in the transverse direction.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A media cassette for an automatic dispenser, comprising:

a cassette body having an interior space in which media to be dispensed may be received;

a push plate installed slidably in the cassette body for supporting media received therein;

an elastic member positioned between the push plate and the cassette body for urging the push plate;

guide means installed between side surfaces of the push plate and inner sides of the cassette body for guiding the push plate to perform linear movement; and locking means installed between the push plate and the cassette body for locking the push plate to the cassette body and for automatically releasing the locking of the push plate from the cassette body rotatably by the pushing of a door of an automatic dispenser when the media cassette is inserted into the automatic dispenser and the door of the automatic dispenser is closed.

2. The cassette of claim 1, wherein the guide means comprises:

a guide rod installed at each side of the cassette body and extending in a longitudinal direction thereof; and a guide hole formed at the each side of the push plate and respectively fixed slidably to the corresponding guide rod.

3. The cassette of claim 2, wherein a bushing is fixed inside each guide hole to facilitate sliding of the push plate.

4. The cassette of claim 1, wherein the locking means comprises:

a hook part coupled to a rear wall of the cassette body and protruded to the inner side of the cassette body for performing locking operation of the push plate;

a hook assembly having a locking release button part protruded to the outside of the cassette body for being operated when the cassette is inserted into an automatic dispenser, to release the locking; and a latching pin provided on the push plate and engageable by the hook assembly.

5. The cassette of claim 4, wherein the hook assembly comprises:

a bracket which is fixed an the installing hole formed in the cassette body;

a hinge shaft fixed to the bracket;

a hook member having a side protruded to the inner side of the cassette body forming a hook part which is protruded outwardly from the cassette body and engageable with the latching pin and another side having a locking release button part for releasing latching operation and being rotatable on the hinge shaft; and a return spring for urging the hook member to its original position on the hinge shaft.

6. The cassette of claim 5, wherein the locking release button part of the hook member is formed protruded outwardly of the cassette body at a certain angle so that the button can be pushed and operate when a door of the automatic dispenser is closed.

7. The cassette of claim 4, wherein the latching pin is fixed to two mounting parts which are protruded at a certain interval from the rear surface of the cassette body.

8. The cassette of claim 4, wherein a retaining ring is fixed at each end of the latching pin.

9. A media cassette for an automatic dispenser, comprising:

a cassette body having an interior space in which media to be dispensed may be received;

a push plate installed slidably in the cassette body for supporting media received therein;

an elastic member positioned between the push plate and the cassette body for urging the push plate;

a guide means installed between each side of the push plate and each side of the cassette body to guide the push plate to perform linear movement; and a width varying means installed on a bottom surface of each sides of the cassette body for varying the width of the interior space in the cassette body according to the size of media to be received therein, wherein the width varying means comprises:

a support panel installed at each side of the cassette body extending in a longitudinal direction for supporting both side edges of the media;

position determining holes formed in a bottom surface at both sides of the cassette body at intervals so that the position of the support panels in a transverse direction of the cassette body can be changed according to the size of the media to be received in the cassette body; and position fixing bolts for fixing the support panels in the position determining holes.

10. A media cassette for an automatic dispenser, comprising:

a cassette body having an interior space in which media to be dispensed can be received;

a push plate installed slidably in the cassette body for supporting media received therein;

an elastic member positioned between the push plate and the cassette body for urging the push plate;

a guide means installed between each side surfaces of the push plate and inner sides of the cassette body for guiding the push plate to perform linear movement;

a locking means installed between the push plate and the cassette body for locking the push plate and for automatically releasing the locking of the push plate from the cassette body rotatably by pushing of a door of an automatic dispenser when the media cassette is inserted into an automatic dispenser and the door of the automatic dispenser is closed; and a width varying means installed on a bottom surface at both sides of the cassette body for varying the width of the cassette body according to the media to be received therein.

11. A media cassette for an automatic dispenser, comprising:

a cassette body having an interior space in which media to be dispensed can be received;

a push plate installed slidably in the cassette body for supporting media received therein;

a elastic member positioned between the push plate and the cassette body for urging the push plate;

a guide means installed between each side surface of the push plate and inner sides of the cassette body for guiding the push plate to perform linear movement;

a locking means installed between the push plate and the cassette body for locking the push plate and for automatically releasing the locking of the push plate when the media cassette is inserted into the automatic dispenser and a door of the automatic dispenser is closed; and a width varying means installed on a bottom surface at both sides of the cassette body for varying the width of the cassette body according to the media to be received, wherein the width varying means comprises:

a support panel installed at each side of the cassette body extending in a longitudinal direction for supporting both side edges of the media;

position determining holes formed in a bottom surface at both sides of the cassette body at intervals so that the position of the support panels in a transverse direction of the cassette body can be changed according to the size of the media to be received in the cassette body; and position fixing bolts for fixing the support panels in the position determining holes.

12. A media cassette for an automatic dispenser, comprising:

a cassette body comprising a dispensing opening, wherein the cassette body is configured to receive media therein;

a push plate configured to slidably support the media within the cassette body, wherein the push plate comprises a latching pin;

an elastic member configured to urge the push plate towards the dispensing opening;

a hook assembly fixed on the cassette body configured to releasably engage the latching pin.

13. The media cassette of claim 12, wherein the hook assembly is configured to releasably engage the latching pin when the push plate is drawn away from the dispensing opening of the cassette body.

14. The media cassette of claim 12, wherein the hook assembly is configured to release the latching pin after the media cassette has been inserted into an automatic dispenser.

15. The media cassette of claim 14, further comprising at least one support panel removably attached to the media cassette and configured to support the media within the cassette and a guide rod configured to slidably engage a guide hole in the push plate in order to guide the push plate towards and away from the dispensing opening.

16. The media cassette of claim 12, wherein the hook assembly comprises a button part configured to release the hook assembly from the latching pin, wherein the button part is configured to be operated after the media cassette has been inserted into an automatic dispenser.

17. The media cassette of claim 12, further comprising at least one support panel removably attached to the media cassette and configured to support the media within the cassette.

18. The media cassette of claim 17, wherein the at least one support panel is configured to be removably attached to the media cassette in multiple positions.

19. The media cassette of claim 17, wherein the cassette body further comprises position determining holes configured to locate the support panel on the cassette body.

20. The media cassette of claim 12, further comprising guide rods configured to slidably to engage guide holes in the push plate in order to guide the push plate towards and away from the dispensing opening.

21. The media cassette of claim 20, wherein the push plate comprises bushings in the guide holes configured to slidably engage the guide rods.

* * * * *